US009970094B2

(12) United States Patent
Tang et al.

(10) Patent No.: US 9,970,094 B2
(45) Date of Patent: May 15, 2018

(54) MODIFIED SLURRY COMPOSITIONS FOR FORMING IMPROVED CHROMIUM DIFFUSION COATINGS

(71) Applicant: PRAXAIR S.T. TECHNOLOGY, INC., North Haven, CT (US)

(72) Inventors: Zhihong Tang, Carmel, IN (US); Kevin E. Garing, Indianapolis, IN (US); Thomas D. Findlay, Lincoln (GB); Thomas F. Lewis, III, Zionsville, IN (US); James K. Knapp, Pittsboro, IN (US)

(73) Assignee: PRAXAIR S.T. TECHNOLOGY, INC., North Haven, CT (US)

( * ) Notice: Subject to any disclaimer, the term of this patent is extended or adjusted under 35 U.S.C. 154(b) by 420 days.

(21) Appl. No.: 14/592,293

(22) Filed: Jan. 8, 2015

(65) Prior Publication Data

US 2015/0197842 A1 Jul. 16, 2015

Related U.S. Application Data

(60) Provisional application No. 61/927,180, filed on Jan. 14, 2014.

(51) Int. Cl.

| | |
|---|---|
| ***B32B 15/01*** | (2006.01) |
| ***C23C 10/20*** | (2006.01) |
| ***C23C 30/00*** | (2006.01) |
| ***C23C 10/04*** | (2006.01) |
| ***C23C 10/32*** | (2006.01) |

(Continued)

(52) U.S. Cl.

CPC ..... *C23C 10/20* (2013.01); *C23C 10/04* (2013.01); *C23C 10/32* (2013.01); *C23C 10/60* (2013.01); *C23C 24/08* (2013.01); *C23C 28/021* (2013.01); *C23C 28/023* (2013.01); *C23C 28/027* (2013.01); *C23C 30/00* (2013.01); *Y10T 428/12847* (2015.01)

(58) Field of Classification Search

CPC ..... B32B 15/01

See application file for complete search history.

(56) References Cited

U.S. PATENT DOCUMENTS 4,904,501 A 2/1990 Davis
5,674,610 A 10/1997 Schaeffer et al.

(Continued)

FOREIGN PATENT DOCUMENTS

EP 0984074 * 3/2000 ..... C23C 10/26
EP 0984074 A1 3/2000

(Continued)

*Primary Examiner* — David Sample
*Assistant Examiner* — Xiaobei Wang
(74) *Attorney, Agent, or Firm* — Nilay S. Dalal

(57) ABSTRACT

Unique and improved chromium coatings derived from modified chromium-containing slurry formulations are disclosed. The slurry formulation includes a combination of a selected halide activator and buffer material that synergistically interact with each other to form chromium diffusion coatings with improved microstructure in comparison to chromium diffusion coatings produced from conventional chromizing processes. The coatings may be locally applied in a controlled manner with accuracy onto various parts, including those having internal sections with complex geometries, without masking any portion thereof.

12 Claims, 2 Drawing Sheets

(51) Int. Cl.

| | |
|---|---|
| ***C23C 10/60*** | (2006.01) |
| ***C23C 24/08*** | (2006.01) |
| ***C23C 28/02*** | (2006.01) |

(56) References Cited

U.S. PATENT DOCUMENTS

| | | | | |
|---|---|---|---|---|
| 6,503,340 | B1 | 1/2003 | Gold et al. | |
| 7,824,738 | B2 | 11/2010 | Smith et al. | |
| 8,262,812 | B2 | 9/2012 | Helmick et al. | |
| 2005/0265851 | A1* | 12/2005 | Madhava | C23C 10/04 416/241 R |
| 2007/0272331 | A1* | 11/2007 | Strasser | C23C 10/04 148/279 |
| 2012/0060721 | A1* | 3/2012 | Kool | C23C 10/18 106/14.21 |
| 2014/0004372 | A1 | 1/2014 | Collins et al. | |

FOREIGN PATENT DOCUMENTS

| | | | |
|---|---|---|---|
| EP | 1788125 | A2 | 5/2007 |
| EP | 2631325 | A2 | 8/2013 |
| GB | 2 401 117 | A | 11/2004 |
| WO | WO 98/07806 | | 2/1998 |

* cited by examiner

MODIFIED SLURRY COMPOSITIONS FOR FORMING IMPROVED CHROMIUM DIFFUSION COATINGS

RELATED APPLICATIONS

This application claims the benefit of priority to U.S. provisional application Ser. No. 61/927,180 filed on Jan. 14, 2014, the disclosure of which is incorporated by reference herein in its entirety.

FIELD OF THE INVENTION

The present invention relates to novel and improved chromium diffusion compositions and coatings that provide corrosion resistance onto metallic substrates.

BACKGROUND OF THE INVENTION

The components in the hot sections of gas turbine engines are susceptible to degradation by hot corrosion attack. Hot corrosion can consume the construction material of turbine engine components at an unpredictably rapid rate, and consequently lead to failure or premature removal of turbine engines. Hot corrosion typically occurs at a temperature range of about 650-950° C.

Molten deposits, such as alkali metal sulfates from intake air or combustion of fuels, are the primary source of hot corrosion. However, other corrosive species such as sulfur dioxide in the environment can accelerate the corrosion attack.

Hot corrosion that is sulfate induced, particularly Type II, has emerged as a concern for engine operation. Many of today's superalloys are more susceptible to Type II corrosion, as they have lower levels of chromium, which as will be explained below, is known to be an effective alloying element in safeguarding against hot corrosion. Additionally, as engine temperature increases, cooler areas of turbine blades, such as in the under platform areas and the surface of internal cooling passages, which were previously operating at temperatures below the onset of hot corrosion, are now becoming exposed to hotter temperature regimes at which Type II hot corrosion can occur. The complicated geometry in these areas can create additional challenges for conventional line-of-sight coating processes such as thermal spray and physical vapor deposition. Rapidly deteriorating air quality in many parts of the world, particularly throughout several countries in Asia, further compounds the problems. Still further, hot corrosion attack often interacts with other degradation modes (i.e., fatigue) during service to accelerate failure of the engine components.

Environmental coatings such as nickel aluminide, platinum aluminide, or MCrAlY overlay coatings are often applied onto the airfoil of gas turbines to enhance oxidation resistance. However, such coatings do not adequately protect engine components against Type II hot corrosion attack.

One method utilized to mitigate hot corrosion attack is the incorporation of chromium onto the surface of a component by a process known as "chromizing". Two common industrial methods for producing chromizing coatings are pack cementation and vapor phase process.

Pack cementation requires a powder mixture including (a) a metallic source (i.e., donor) of chromium, (b) a vaporizable halide activator, and (c) an inert filler material such as aluminum oxide. Parts to be coated are entirely encased in the pack materials and then enclosed in a sealed chamber or retort. The retort is then heated in a protective atmosphere to a temperature between 1400-2100° F. for 2-10 hours to allow chromium to diffuse into the surface. Although the pack chromizing process has been used since the 1950's, there are several major limitations. First, the pack process generates a large amount of hazardous waste and requires considerable more raw materials than other processes. Second, the pack process is difficult to fully coat selective regions of the parts with complicated geometries, such as the surface of internal cooling passages.

The vapor phase process generally involves placing the parts to be coated into a retort in an out-of-contact relationship with a chromium source and halide activator. The vapor phase process can coat both the external and the internal surfaces of a part, such as a turbine blade having a complicated geometry. However, the chromium content within the resultant coating is generally too low to provide sufficient protection against Type II hot corrosion attack. Furthermore, it is difficult to mask the area where no "chromizing coating" is required. Consequently, the vapor phase process has a tendency to produce a chromizing coating along all surfaces of the part.

Another type of chromizing process is the slurry process described in U.S. Pat. Nos. 4,904,501 and 8,262,812. In the slurry process, a thin layer of aqueous slurry comprising chromium powder and halide activator is directly applied to the substrate surface. The slurry process requires much less raw materials than the pack method, and eliminates the exposure to dust particulates characteristic of the pack method. One of the major limitations of existing slurry processes is that the coating microstructure comprises greater than or equal to 40% by volume alpha chromium ("α-chromium"), which can cause the coating to have poor fatigue crack resistance.

All of the conventional chromizing processes suffer from major drawbacks. First, substantial amounts of oxide and nitride inclusions are formed in the chromizing coating. The inclusions tend to reduce the erosion, fatigue and corrosion resistance of the coating. A second drawback is the formation of a thick and continuous alpha-chromium layer. Although the α-chromium layer offers excellent resistance to type II hot corrosion attack, the α-chromium is brittle and susceptible to thermal fatigue cracking during service. The cracking can propagate into the substrates and lead to the premature failure of the coated system.

In view of the drawbacks of existing chromizing processes there is a need for a new generation chromizing process that can produce a chromium enrich layer with significant reduced level of nitrides, oxides and α-chromium phase, thereby overcoming the current limitations of existing pack, vapor phase and slurry chromizing processes. Furthermore, there is a need for a simple method that can produce a chromizing coating on the selective regions and minimizes masking requirements for areas where "no coatings" are required. There is a need for a method that utilizes considerable fewer raw materials and minimizes exposure of hazardous materials in the workplace. Other advantages and applications of the present invention will become apparent to one of ordinary skill in the art.

SUMMARY OF THE INVENTION

The invention may include any of the following aspects in various combinations and may also include any other aspect of the present invention described below in the written description.

In a first aspect, a slurry composition is provided, comprising: a chromium source comprising elemental chromium powder, alloyed chromium powder, chromium-containing compounds or a mixture thereof; a non-nitrogen halide activator characterized by the absence of ammonium halide; a buffer material selected from the group consisting of nickel, cobalt, silicon, aluminum, silicon, titanium, zirconium, hafnium, yttrium, manganese and any combination thereof; and a binder solution, said binder solution comprising a binder material dissolved in a solvent, said solvent compatible with each of the non-nitrogen halide activator and the binder material.

In a second aspect, a chromium diffusion coating is provided. The coating comprises an outer α-Cr layer comprising a thickness from about 0% to about 10% of a total coating thickness; an inner nickel-chromium layer comprising between about 15% to about 50% chromium by weight; wherein said coating is characterized by a substantial reduction of oxide and nitride inclusions in comparison to chromium diffusion coatings derived from conventional slurry chromizing processes.

In a third aspect, a chromium diffusion coating is provided that is prepared by the process comprising the steps of providing a substrate; providing slurry constituents comprising: a chromium source comprising elemental chromium powder, alloyed chromium powder, chromium-containing compounds or a mixture thereof; a non-nitrogen halide activator characterized by the absence of ammonium halide; a buffer material selected from the group consisting of nickel, cobalt, silicon, aluminum, silicon, titanium, zirconium, hafnium, yttrium, manganese and any combination thereof; and a binder solution, said binder solution comprising a binder material dissolved in a solvent; mixing said constituents to from a slurry composition; applying said slurry composition onto a metallic substrate; heating said slurry from about 1600 F to about 2100 F for a duration ranging up to about 24 hours; and forming said chromium diffusion coating within said substrate.

In a fourth aspect, an article coated by the slurry composition of claim 1 is provided.

BRIEF DESCRIPTION OF THE DRAWINGS

The objectives and advantages of the invention will be better understood from the following detailed description of the preferred embodiments thereof in connection with the accompanying figures wherein like numbers denote same features throughout and wherein.

DETAILED DESCRIPTION OF THE INVENTION

Figure 1:
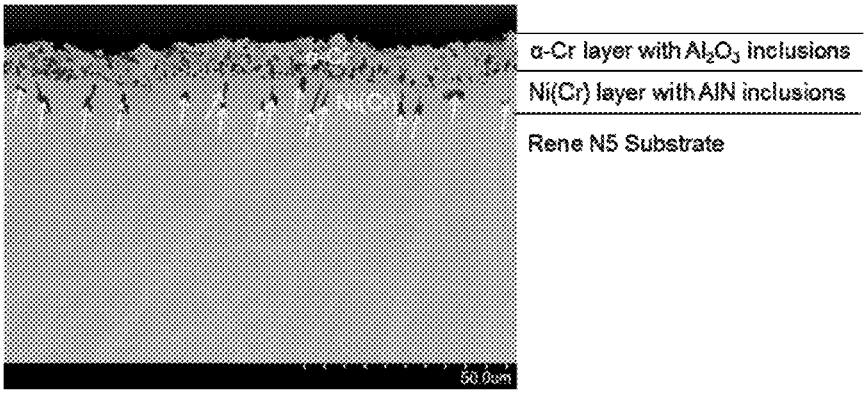
FIG. 1 shows across-sectional microstructure of a chromium diffusion layer using a slurry composition (slurry A) which comprises an ammonium chloride activator, whereby the resultant coating contains a significant amount of detrimental nitride inclusions, and brittle α-chromium phase.

The objectives and advantages of the invention will be better understood from the following detailed description of the preferred embodiments thereof in connection. The present disclosure relates to novel slurry formulations which produce improved chromium diffusion coatings. The disclosure is set out herein in various embodiments and with reference to various aspects and features of the invention.

The relationship and functioning of the various elements of this invention are better understood by the following detailed description. The detailed description contemplates the features, aspects and embodiments in various permutations and combinations, as being within the scope of the disclosure. The disclosure may therefore be specified as comprising, consisting or consisting essentially of, any of such combinations and permutations of these specific features, aspects, and embodiments, or a selected one or ones thereof.

Generally speaking, the slurry chromizing process is considered to be a chemical vapor deposition process. Upon heating to elevated temperature, the chromium source and the halide activator in the slurry mixture react to form volatile chromium halide vapor. Transport of the chromium halide vapor from the slurry to the surface of the alloy to be coated takes place primarily by the gaseous diffusion under the influence of chemical potential gradient between the slurry and the alloy surface. Upon reaching the alloy surface, these chromium halide vapors react at the surface and deposit chromium, which diffuses into the alloy to form the coating. As will be explained, the nature of constituents in the slurry mixture defines the thermodynamic condition of the chromizing process and dictates the final coating composition and microstructure.

A novel chromizing composition has been discovered with significantly improved erosion, fatigue and corrosion resistance characteristics as a result of suppressing, minimizing or substantially eliminating oxide and nitride inclusions along with the α-chromium phase. The resultant chromium diffusion coatings of the present invention have the ability to be locally applied to selected regions of metallic substrates, in comparison to conventional chromizing processes, and further in a manner that produces less material waste. Unless indicated otherwise, it should be understood that all compositions are expressed as weight percentages (wt %).

The chromizing compositions of the present invention represent a substantial improvement over conventional chromium diffusion coatings produced from pack, vapor or slurry processes. The improved formulation is based, at least in part, upon the selected combination of specific halide activators and buffer materials within the slurry formulation. One embodiment of the present invention is directed to modified slurry compositions which produce a chromium diffusion coating containing substantial reduced level of nitrides, oxides and alpha-chromium phase. The slurry composition comprises a chromium source, a specific class of halide activator, a specific buffer material, a binder material and a solvent. The slurry composition of the present invention comprises a chromium source in a range from about 10% to about 90% of the slurry weight; a halide activator in a range from about 0.5% to about 50% of the chromium source weight, a buffer material ranging from about 0.5% to about 100% of the chromium source; a binder solution in a range from about 5% to about 50% of the slurry weight in which the binder solution includes a binder and a solvent. An optional inert filler material may be provided that ranges from about 0% to about 50% of the slurry weight. In a preferred embodiment, the chromium source is in a range from about 30% to about 70%; the halide activator is in a range from about 2% to about 30% of the chromium source, the buffer material is in a range from about 3% to about 50% of the chromium source; the binder solution in a range from about 15% to about 40% of the slurry weight; and the optional inert filler material is in a range from about 5% to about 30% of the slurry weight.

Various chromium sources may be utilized, including elemental chromium powder or alloyed chromium powder or a mixture thereof. The chromium powder may be alloyed with other metals such as Fe—Cr, Ni—Cr, Co—Cr and Cr—Si alloy powders. The chromium source may also be selected from a chromium-containing compound such as $Cr_3C_2$. Any particle size is contemplated by the present invention. In a preferred embodiment, the chromium source powders employed in the slurry composition have a particle size of −200 mesh (i.e., 74 microns) or finer.

In accordance with the present invention, the activator has the ability to readily react with the chromium source and produce chromium halide vapors and produce Cr-containing diffusion coatings without producing elevated levels of contaminant inclusions typically encountered with conventional chromizing processes. The slurry composition of this invention comprises a specific class of halide activators. Specifically, the present invention utilizes activators such as, by way of example, but not limited to, aluminum fluoride, chromium fluoride, aluminum chloride, chromium chloride and any combination thereof. The activators specifically exclude metal halides which contain ammonium halides, as these categories of activators adversely affect corrosion properties and microstructure of the coating. While the exact mechanism is not known, the prescribed halide activators appear to have a tendency to interact with the chromium source yet still maintain chromium activity at a level that does not generate enriched α-chromium phase.

As previously mentioned, the halide activators of the present invention are present in the slurry composition in an amount of about 0.5% to about 50%, and more preferably from about 2% to about 30% of the weight of the chromium source. It has been discovered that incorporating the activator in an amount below 0.5% of chromium source can produce a thin chromizing coating with low chromium content, thereby imparting inadequate corrosion resistance. The presence of the activators in excess of 50% of the chromium source appears to confer no additional benefit and may in some instances attack the coating.

The halide activator in the inventive slurry generates volatile chromium halide vapors by reacting with the chromium source powder at elevated temperatures. The chromium halide vapors can then transport to the surface of a metallic substrate and produce the desired coating composition and microstructure by solid state diffusion. As will be shown in the Examples, the specific type of halide salt selected as the activator in the slurry mixture can impact the final coating microstructure and coating composition. In particular, it has been discovered that metal halides which contain ammonium halides create poor coating compositions having nitride inclusions. Ammonium halides, such as ammonium chloride, are commonly used in the conventional chromizing process due to their activation effectiveness (i.e., ability to readily react with the chromium source and produce chromium halide vapors). However, without being bound by particular theory, the use of an ammonium halide activator may promote the formation of substantial amounts of nitride inclusions within the coating, which can significantly degrade the corrosion, erosion and fatigue resistance of the coating. Upon heating, ammonium halides can rapidly decompose into nitrogen, hydrogen and halogen gases. While halogen gas reacts with chromium source to form volatile chromium halide vapor and form a coating on a metallic substrate, nitrogen from the decomposition of ammonium halides can react with active elements, such as aluminum and titanium, in the metallic substrate and form internal nitride inclusions within the coating.

Besides nitride formation in the coating, the rapid decomposition of ammonium halides also generates undesirable high pressure in the coating retort which can pose a safety risk during the coating operation. The process variables such as gas flow through the container or amount of activator can be adjusted to reduce pressure. However, while such adjustments reduce the amount of nitride phases in the coating, the resultant coating thickness and/or composition is compromised.

Accordingly, the present invention utilizes a non-nitrogen containing halide activator so as to suppress, substantially reduce or eliminate the amount of internal nitride inclusions in the coating. A non-nitrogen containing halide activator also results in significantly lower levels of deleterious α-chromium phase along the outer region of the coating.

In another embodiment of the present invention, the halide activator excludes nitrogen, alkali metal halides, such as sodium chloride, and alkaline earth metal halides such as magnesium chloride. Although alkali metal halides and alkaline earth metal halides exhibit higher stability than ammonium halides, the present invention recognizes that alkaline or alkaline earth metal elements may in some applications have a tendency to be incorporated into the resultant chromizing coating during the coating process. Incorporation of the alkali metal halides or alkaline earth metal halides in some instances may adversely affect the corrosion properties of the coating.

In addition to selection of the proper activator being present at the prescribed optimal range in the slurry, the slurry composition of the present invention is further defined by the proper selection of one or more additional buffer powders (i.e., buffer material as listed in Table 1). The buffer material may include nickel, cobalt, silicon, aluminum, silicon, titanium, zirconium, hafnium, yttrium, manganese and any combination thereof in a range from about 0.5% to about 100%, and more preferably from about 5% to about 80% of the weight of the chromium source. The buffer material has a high affinity for oxygen and nitrogen, and can therefore effectively getter residual nitrogen and oxygen in the slurry and retort atmosphere. Furthermore, the buffer lowers the chemical activity of chromium in the slurry to a level which suppresses or reduces the level of brittle α-chromium phase in the outer layer of the chromizing coating, but which maintains sufficient chromium chemical activity to form the necessary chromium within the inner layer. In this manner, the synergistic combination of the buffer material with suitable halide activator in accordance with the principles of the present invention reduces the level of nitride and oxide inclusions while also lowering α-chromium phase in the coating to levels not attainable by coatings produced from conventional pack, vapor or slurry chromizing processes.

Careful selection of the buffer material in combination with the halide activator in accordance with principles of the present invention is required to generate improved chromium diffusion coatings. As will be shown by the Examples, the superior coating characteristics of the present invention are not solely based on the buffer material, but also selection of a suitable halide activator that is compatible with the buffer material. Further, the halide activator is contained in optimal amounts within the slurry formulation. Under such conditions, the halide activator synergistically interacts with the buffer material to allow the levels of nitride, oxide and α-chromium phase in the coating to be suppressed, minimized or substantially eliminated. In this regard, a comparison of Example 1 and Comparative Example 3, each of which will be discussed below in greater detail, shows that although the slurry formulation of Comparative Example 3 utilized a nickel and aluminum metallic powder mixture, the proper type of halide (i.e., exclusion of nitrogen containing halide activators) was not incorporated. As a result, the coating of Comparative Example 3 was inferior to Example 1, which utilized both the nickel and aluminum powder mixture along with an aluminum fluoride activator. The interaction of these and other constituents in the slurry formulation of Example 1 facilitated generation of significantly lower levels of nitride, oxide and α-chromium phase in the resultant coating.

The slurry composition of the present invention further comprises a binder solution, which contains a binder material dissolved in a solvent. The binder solution functions to hold the slurry constituents together without detrimentally interfering with the slurry constituents or the coated substrate. The binder must be capable of burning off cleanly and completely without interfering with the chromizing reactions. A preferred binder is hydroxypropylcellulose, which is commercially available under the trade name Klucel™, from Ashland Incorporation. Other binders may also be suitable for the present invention, including by way of example. a B-200 binder commercially made and sold by APV Engineered Coatings (Akron, Ohio). The selected binder exhibits compatibility with the halide in the slurry composition or formulation. In particular, the halide activator does not react with the binder material and solvent, nor affect the physical and chemical properties of the binder solutions. For example, if a water-based binder solution was used, the particular halide activator that is selected preferably exhibits negligible solubility in water. Otherwise, the relatively high concentrations of dissolved halide activator in the water-based binder solution may have a tendency to cause the binder to gradually precipitate out of the water-based binder solution, thereby leading to a short shelf-life of the slurry.

The solvent employed in the slurry coating compositions of the present invention is chosen such that its volatility, flammability, toxicity and compatibility with both halide activator and binder are taken into consideration. In a preferred embodiment, the solvent includes deionized water. The amount of binder solution accounts for about 5% to about 50%, and more preferably from about 15% to about 40% of the weight of the slurry.

The slurry composition optionally comprises a filler that can range from about 0% to about 50%. The filler material is chemically inert. The inert filler material does not participate in the chemical reactions in the slurry. Instead, the filler material is designed to impart a dilution effect to the slurry mixture. The inert filler material can also adjust the viscosity of the slurry mixture. In a preferred embodiment, alumina powder is utilized as the inert filler material. Other types of filler materials can be utilized, such as silica and kaolin.

The slurries of the present invention have demonstrated long shelf-lives that range at least 3 months, and more preferably at least 6 months with regards to the binder material remaining in the solvent and the solid contents remaining unreactive and stable in the binder solution.

The slurry compositions of the present invention can be applied to a metallic substrate by conventional methods such as brushing, spraying, dipping and injecting. The method of application depends, at least in part, on the viscosity of the slurry composition, as well as the geometry of the substrate surface. The slurry can be applied either to all surfaces of the substrate, or only to the selective regions of a substrate without specific tooling requirements. Advantageously, the ability to locally apply the slurry to only desired regions of the metallic substrate eliminates the need to utilize masking techniques.

The slurry composition is applied onto the metallic substrate and dried either with warm air in a convection oven, or under infrared lamp or the like. The slurry-coated substrate is then heated to 1600° F.-2100° F. for a duration ranging up to about 24 hours, and more preferably from about 2 hours to about 12 hours to allow the formation of chromium diffusion coating. During the processing, adequate flow of argon, hydrogen or the mixture is maintained to purge substantially all of the binder outgassing from the retort.

After processing, slurry residues can be removed by various methods, including wire blush, oxide grit burnishing, glass bead, high-pressure water jet or other conventional methods. Slurry residues typically comprise unreacted slurry compositional materials. The removal of any slurry residue is conducted in such a way as to prevent damage to the underlying chromizing surface layer.

Preferably, the slurry coating compositions of the invention are formulated for application onto nickel-based, cobalt-based or iron-based alloys. A nickel based alloy, for example, is an alloy having a matrix phase having nickel as the proportionally largest elemental constituent (by weight). Other elements such as aluminum may be added to the nickel based alloy to impart improvements in physical or chemical properties.

The chromizing coating consists of two layers: an outer α-Cr layer containing above 70% Cr, by weight, and an inner Ni(Cr) layer defined as chromium in a solid solution of nickel. In accordance with the principles of the present invention, the combination of a specific activator and a specific buffer material at certain levels interacts with each other to facilitate formation of a chromizing coating which contains a significantly reduced level of nitride, oxide inclusions and α-chromium phase. The inner Ni(Cr) layer contains a nickel-chromium phase comprising about 15% to about 50% chromium by weight, more preferably about 25% to about 40%. The chromium content in the Ni(Cr) is sufficient to impart the desired corrosion resistance for various end-use applications, including aerospace applications. The thickness of the outer α-chromium layer coating is reduced over conventional chromium diffusion coatings to only account for about 0% to about 40%, and more preferably from about 0% to about 10% of the total coating thickness, thereby allowing the coating to maintain adequate fatigue resistance while eliminating brittleness typically encountered with large amounts of α-chromium layer formed in the outer layer.

The examples below demonstrate the unexpected improvements in utilizing a modified slurry formulation to form chromium diffusions coatings of the present invention in comparison to conventional coatings.

Comparative Example 1

A slurry composition, designated "Slurry A", was prepared by a conventional formulation typically used in conventional pack, vapor, or slurry chromizing processes. Slurry A comprised elemental chromium powders and an ammonium chloride activator. Slurry A was prepared by mixing the following: 100 g chromium powder, −325 mesh; 5 g ammonium chloride (halide activator); 4 g Klucel™ hydroxypropylcellulose (binder); 51 g deionized water (solvent); and 40 g alumina powder (inert filler material).

The slurry A was applied onto the surface of a Rene N5 specimen by dipping. Rene N5 is a single crystal nickel-based superalloy having a nominal composition of, by weight, about 7.5% Co, 7.0% Cr, 6.5% Ta, 6.2% Al, 5.0% W, 3.0% Re, 1.5% Mo, 0015% Hf, 0.05% C, 0.004% B, 0.01% Y, the balance nickel.

The slurry coating was allowed to dry in an oven at 80° C. for 30 minutes followed by curing at 135° C. for 30 minutes. The coated specimen was then diffusion heat-treated in a flowing argon atmosphere at 2010° F. for 4 hours. After cooling, the slurry residues were removed from the surface of the specimen by grit blasting with 220 mesh alumina.

The coated specimen was cross-sectioned for metallurgical analysis. FIG. 1 shows the resultant coating microstructure. The results are summarized in Table 1.

Two microstructure characteristics were observed in FIG. 1, which is very similar to chromizing coatings formed by conventional pack, vapor, or slurry chromizing process. First, the coating contained a continuous outer α-chromium layer. The thickness of the α-chromium layer accounted for 40% of total coating thickness. Such a thickness along the outer region of the region generated unacceptable brittleness that is detrimental to the mechanical performance of the coated specimen. Second, the coating was observed to contain significant amounts of internal nitride and oxide inclusions, which can degrade the corrosion and erosion performance of the coating. Aluminum oxide inclusions were primarily interspersed in the outer α-chromium layer of the coating while aluminum nitride inclusions were located in the inner layer of nickel-chromium solid solution. White arrows in FIG. 1 indicated the aluminum nitride inclusions in the form on angular inclusions in the inner layer of the coating. The nitride phase is marked with white arrows in FIG. 1.

The volume fraction of nitride and oxide inclusions was measured by an automatic image analyzer in a manner as specified by ASTM E1245. The inclusions were to be 14.5%.

Comparative Example 2

A second slurry composition, designated "slurry B", was prepared in accordance with the present invention by replacing the ammonium chloride activator in slurry A with an aluminum fluoride activator. The slurry B contained: 100 g chromium powder, −325 mesh; 20 g aluminum fluoride (halide activator); 4 g Klucel™ hydroxypropylcellulose (binder); 51 g deionized water (solvent); and 25 g alumina powder (inert filler).

Slurry B was applied to a Rene N5 specimen and diffusion-treated in an argon atmosphere at 2010° F. for 4 hours, as set forth in Comparative Example 1. The coated specimen was cross-sectioned for metallurgical analysis. The results are summarized in Table 1.

Figure 2:
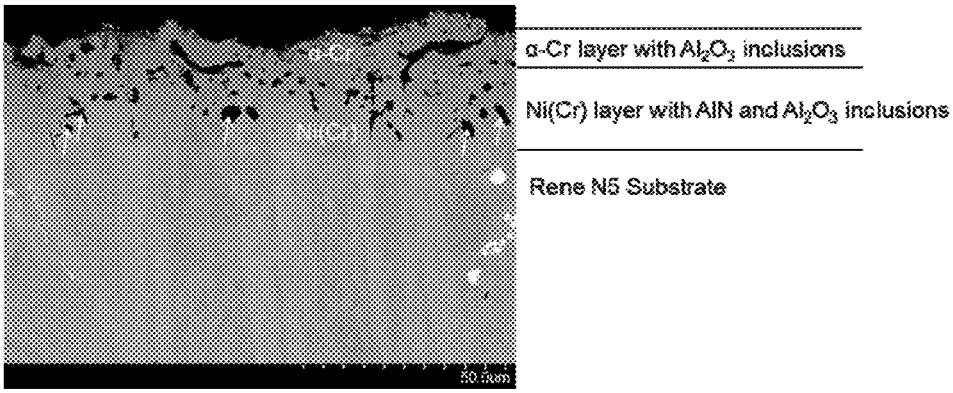
FIG. 2 shows a cross-sectional microstructure of a chromium diffusion layer using a slurry composition (slurry B) in accordance with the present invention which comprises an aluminum fluoride activator, whereby the resultant coating exhibited the reduced level of detrimental nitride inclusions and brittle α-chromium phase in the coating.

FIG. 2 shows the resultant coating microstructure that was produced. The deleterious α-chromium phase was reduced in comparison to Comparative Example 1. Specifically, the thickness of the outer α-chromium layer using slurry B only accounted for 14% of the total coating thickness, compared to 40% using slurry A in Comparative Example 1.

It was observed that the amount of internal nitride inclusions in the coating was significantly reduced by replacing the ammonium chloride in slurry A with aluminum fluoride in slurry B, thereby eliminating a nitrogen precursor source for nitride formation in the coating. The volume of nitride and oxide inclusions in the coating was reduced from 14.5% using slurry A (Comparative Example 1) to 11.6% using slurry B. Nonetheless, the amount of inclusions was determined to be unacceptably high so as to result in poor erosion, corrosion and fatigue resistance of the coating.

Comparative Example 3

Tests were performed to assess the microstructure and composition of a coating prepared from a slurry formation typically utilized when forming coatings from standard pack processes. In this regard, ammonium chloride and a buffer material containing a mixture of nickel and aluminum powders were incorporated into the slurry composition. The slurry composition, designated "Slurry C", was prepared by mixing the following: 70 g chromium powder, −325 mesh; 5 g ammonium chloride (halide activator); 4 g Klucel™ hydroxypropylcellulose (binder); 51 g deionized water (solvent); 25 g nickel powder and 5 g aluminum powder (metallic buffer powder); and 40 g alumina powder (inert filler material).

Slurry C was applied to a Rene N5 specimen and diffusion-treated in an argon atmosphere at 2010° F. for 4 hours as set forth in Comparative Example 1. The coated specimen was cross-sectioned for metallurgical analysis. The results are summarized in Table 1.

Figure 3:
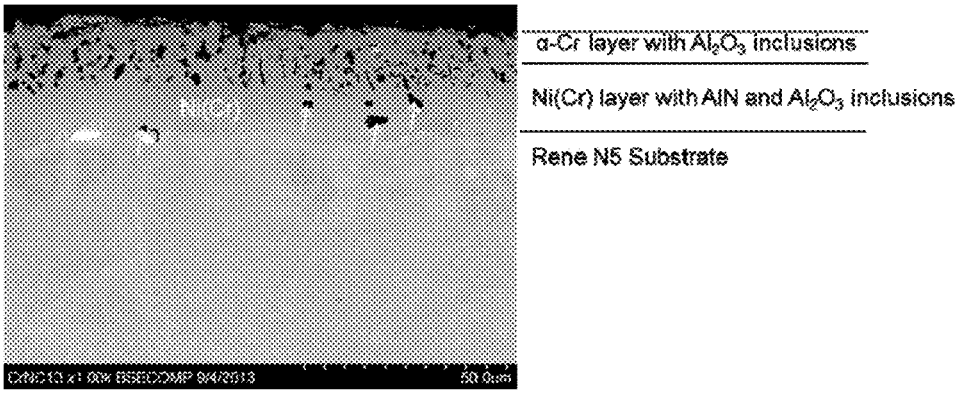
FIG. 3 shows a cross-sectional microstructure of a chromium diffusion layer using a slurry composition (slurry C) which comprises an ammonium chloride activator, nickel powder, and aluminum powder, whereby the addition of nickel and aluminum powder into slurry A only slightly reduced detrimental nitride and oxide inclusions, and brittle α-chromium phase in the coating.

FIG. 3 shows the resultant coating microstructure. The addition of nickel and aluminum powder reduced the amount of nitride and oxide inclusions in the coating to 13.2% using slurry C in comparison to the coating produced from Slurry A of Comparative Example 1, which exhibited a volume fraction of 14.5% of inclusions. The addition of nickel and aluminum powder only slightly reduced the fraction of deleterious α-chromium phase, from 40% by thickness using slurry A to 30% by thickness using slurry C. The results indicated that the ammonium chloride negatively impacted the coating and offset any benefits provided by the buffer material. It was determined from the test that a pack formulation could not be successfully utilized in a slurry chromizing process to produce clean coatings with favorable microstructure (i.e., absence of nitride and oxide inclusions and reduced alpha-chromium).

Example 1

Tests were performed to assess the microstructure and composition of a coating prepared from a slurry formation that replaced the ammonium chloride activator in Slurry C with an aluminum fluoride activator. In this regard, "Slurry D", was prepared by mixing the following: 70 g chromium powder, −325 mesh; 20 g aluminum fluoride (activator); 4 g Klucel™ hydroxypropylcellulose (binder); 51 g deionized water (solvent); 25 g nickel powder and 5 g aluminum powder (buffer material); and 25 g alumina powder (inert filler material).

Slurry D was applied to a Rene N5 specimen and diffusion-treated in argon atmosphere for 4 hours as set forth in Comparative Example 1. The coated specimen was cross-sectioned for metallurgical analysis. Results are summarized in Table 1.

Figure 4:
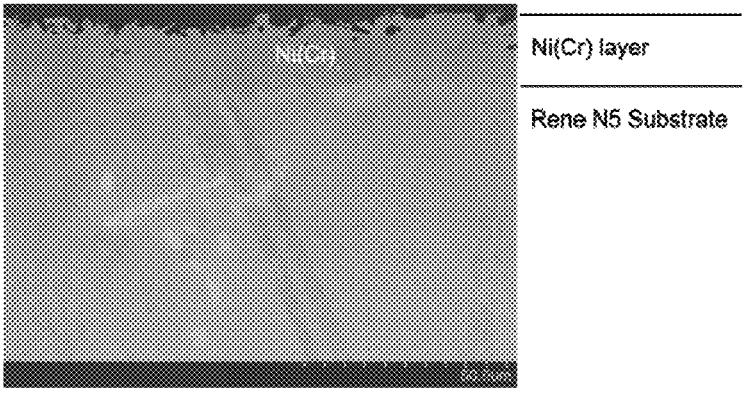
FIG. 4 shows a cross-sectional microstructure of a chromium diffusion layer using a slurry composition (slurry D) in accordance with the invention which comprises an aluminum fluoride activator, nickel powder, and aluminum powder, whereby the addition of nickel and aluminum powder into slurry B significantly reduced detrimental nitride and oxide inclusions, and brittle α-chromium phase in the coating.

FIG. 4 shows the resultant coating microstructure. It was observed that the combination of aluminum fluoride activator, nickel and aluminum powder led to a significant reduction of nitride and oxide inclusions, as well as the α-chromium phase in the coating. The resultant coating contained insignificant amounts, 2.6% by volume, of nitride and oxide inclusions, compared to 13.2% using slurry C (Comparative Example 3), and 11.6% using slurry B (Comparative Example 2). Furthermore, the thickness of the outer α-chromium layer accounted for 4% of total coating thickness, compared to 30% using slurry C or 14% using slurry B. The results indicated that a non-nitrogen halide activator favorably interacted with the buffer material during formation of the diffusion coating, and, as a result, both the correct halide activator and buffer material was required to produce improved coatings.

Example 2

Further tests were performed to evaluate a coating composition and microstructure prepared from a slurry containing a non-nitrogen halide activator and metallic buffer powder containing nickel. In this regard, a slurry composition, designated "slurry E", was prepared in accordance with the present invention by removing the aluminum powder from slurry D. Slurry E was prepared by mixing the following: 75 g chromium powder, −325 mesh; 20 g aluminum fluoride (halide activator); 4 g Klucel™ hydroxypropylcellulose (binder); 51 g deionized water (solvent); 25 g nickel powder (buffer material); and 25 g alumina powder (inert filler material).

The slurry E was applied to a Rene N5 specimen and diffusion-treated in argon atmosphere for 4 h as set forth in Comparative Example 1. The coated specimen was cross-sectioned for metallurgical analysis. Results are summarized in Table 1.

Figure 5:
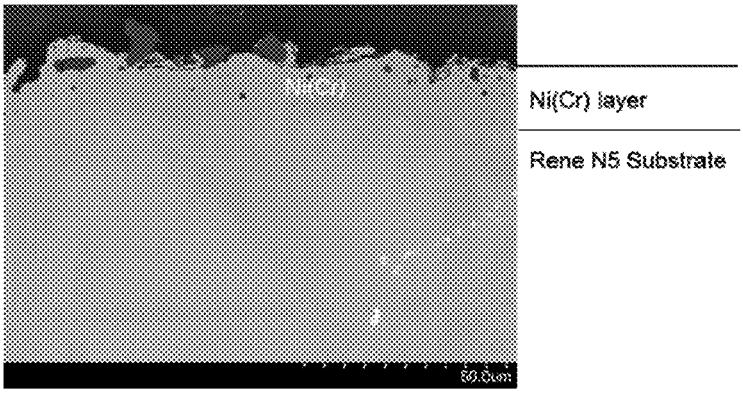
FIG. 5 shows a cross-sectional microstructure of a chromium diffusion layer using a slurry composition (slurry E) in accordance with the present invention which comprises an aluminum fluoride activator and nickel powder, whereby the addition of nickel powder into slurry B significantly reduced detrimental nitride and oxide inclusions, and brittle α-chromium phase in the coating.

FIG. 5 shows the resultant coating microstructure. The results were comparable to that of Example 1. The combination of aluminum fluoride activator and nickel powder led to the significant reduction of nitride and oxide inclusions, and α-chromium phase in the coating. The resultant coating contained insignificant amounts, 2.5% by volume, of nitride and oxide inclusions, compared to 13.2% using slurry C (Comparative Example 3), and 11.6% using slurry B (Comparative Example 2). Additionally, the thickness of the outer α-chromium layer accounted for less than about 2% of total coating thickness, compared to 30% using slurry C or 14% using slurry B.

TABLE I

Slurry Composition and the Resultant Coating Microstructure

| | Slurry Formula | | Coating characterization | | |
|---|---|---|---|---|---|
| Slurry | Activator | Buffer material | Volume fraction of inclusions, % | Thickness percent of α-Cr layer, % | Average Cr content in Ni(Cr) layer, wt. % |
| A | $NH_4Cl$ | — | 14.5 | 40% | 20-25% |
| B | $AlF_3$ | — | 11.6 | 14% | 25-40% |
| C | $NH_4Cl$ | Ni, Al | 13.2 | 30% | 20-25% |
| D | $AlF_3$ | Ni, Al | 2.6 | <4% | 25-40% |
| E | $AlF_3$ | Ni | 2.5 | <2% | 25-40% |

As has been shown, the present invention offers a unique slurry formulation that produces chromium diffusion coatings that are advantageous over chromium diffusion coatings produced from conventional chromizing slurry, pack and vapor phase processes. In particular, the Examples demonstrate that the present invention produces superior chromium coating composition and microstructure (i.e., reduced inclusions and reduced α-chromium) in comparison to those produced from conventional slurry chromizing processes. As a result, the coatings of the present invention have improved properties, including higher resistance to corrosion, erosion and fatigue.

Further, the slurries of the present invention are advantageous in that they can be selectively applied with control and accuracy onto localized regions of the substrate by simple application methods, including brushing, spraying, dipping or injecting. On the contrary, conventional pack and vapor phase processes cannot locally generate chromium coatings along selected regions of a substrate. As a result, these conventional coatings require difficult masking techniques which typically are not effective in concealing those regions along the metallic substrate not desired to be coated. To overcome masking challenges, chromizing vapor and pack processes utilize a post-coating machining step to remove excess coating from undesired surfaces of the metallic substrate.

The ability for the present invention to locally apply slurry formulations to form coatings has the added benefit of significantly lower material waste. As such, the present invention can conserve overall slurry material and reduce waste disposal, thereby creating higher utilization of the slurry constituents. No masking is required, thereby reducing the raw materials required for coating and minimizing exposure of hazardous materials in the workplace. On the contrary, pack processes typically require significantly higher amounts of material that results in more waste material. Similar deficiencies exist for vapor phase processes.

Still further, unlike pack and vapor phase processes, the modified slurry formulations of the present invention can be used to form the improved chromium coatings onto various parts having complex geometries and intricate internals. Pack and vapor processes have limited versatility, as they can only be applied to parts having a certain size and simplified geometry.

The principles of the present invention may be utilized to coat any suitable substrate requiring controlled application of chromizing coatings. In this regard, the methods of the present invention can protect a variety of different substrates that are utilized in other applications. For example, the chromizing coatings as used herein may be locally applied in accordance with the principles of the present invention onto stainless steel substrates which do not contain sufficient chromium for oxidation resistance. The chromizing coatings in such applications form a protective oxide scale along the stainless steel substrate.

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. A slurry composition comprising:

a chromium source consisting essentially of elemental chromium powder;

a non-nitrogen halide activator characterized by the absence of ammonium halide;

a buffer material selected from the group consisting of cobalt, aluminum, titanium, zirconium, manganese, silicon, hafnium, yttrium and any combination thereof; and further comprising nickel powder and a binder solution, said binder solution comprising a binder material dissolved in a solvent, said solvent compatible with each of the non-nitrogen halide activator and the binder material.

2. The slurry composition of claim 1, wherein said chromium source is in a range from about 10% to about 90% of the slurry weight, said halide activator is in a range from about 0.5% to about 50% of the chromium source weight, said binder solution is in a range from about 5% to about 50% of the slurry weight and said buffer material is in a range from about 0.5% to about 100% of the chromium source weight, wherein the aggregate of said chromium source, said halide activator, said binder solution and said buffer material is equal to 100% of the slurry weight.

3. The slurry composition of claim 1, wherein said chromium source is in a range from about 30% to about 70% of the slurry weight, said halide activator is in a range from about 2% to about 30% of the chromium source weight, said buffer material is in a range from about 3% to about 50% of the chromium source weight; said binder solution in a range from about 15% to about 40% of the slurry weight, wherein the aggregate of said chromium source, said halide activator, said binder solution and said buffer material is equal to 100% of the slurry weight.

4. The slurry composition of claim 1, further comprising an inert filler material.

5. The slurry composition of claim 1, wherein said activator comprises aluminum trifluoride.

6. The slurry composition of claim 1, wherein the halide activator further comprises the absence of alkali metal halides and alkaline earth metal halides.

7. The slurry composition of claim 1, wherein said solvent is deionized water.

8. A chromium diffusion coating prepared by the process comprising the steps of:

providing a substrate;

providing slurry constituents comprising: a chromium source consisting essentially of elemental chromium powder;

a non-nitrogen halide activator characterized by the absence of ammonium halide;

a buffer material selected from the group consisting of cobalt, aluminum, titanium, zirconium, manganese, silicon, hafnium, yttrium and any combination thereof; and further comprising nickel powder a binder solution, said binder solution comprising a binder material dissolved in a solvent;

mixing said constituents to from a slurry composition;

applying said slurry composition onto the substrate;

heating said slurry composition from about 1600 F to about 2100 F for a duration ranging up to about 24 hours; and forming said chromium diffusion coating within said substrate.

9. The coating of claim 8, wherein the step of applying said slurry composition further comprises locally applying said composition to predetermined selective regions without masking any portion of said metallic substrate.

10. The coating of claim 8, further prepared by the step of flowing argon, hydrogen or a mixture thereof at a sufficient flow rate to purge substantially all of the binder outgassing.

11. An article coated by the slurry composition of claim 1.

12. The article of claim 11, said article defined by an internal section having a complex geometry, said complex geometry coated by the slurry composition of claim 1.

* * * * *